US007241165B2

(12) United States Patent
Scheer et al.

(10) Patent No.: US 7,241,165 B2
(45) Date of Patent: Jul. 10, 2007

(54) ELECTRICAL CONNECTOR FOR FLAT CABLES AND CONTACT ELEMENT THEREFOR

(75) Inventors: Joerg Scheer, Hüllhorst (DE); Walter Hanning, Detmold (DE); Heike Schmidtpott, Bad Salzuflen (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/585,016

(22) Filed: Oct. 23, 2006

(65) Prior Publication Data

US 2007/0099484 A1 May 3, 2007

(30) Foreign Application Priority Data

Oct. 28, 2005 (DE) ..... 20 2005 016 912 U
Nov. 9, 2005 (DE) ..... 20 2005 018 318 U

(51) Int. Cl.
*H01R 12/24* (2006.01)

(52) U.S. Cl. ..... 439/492; 439/272

(58) Field of Classification Search ..... 439/271–272, 439/492–499

See application file for complete search history.

(56) References Cited

U.S. PATENT DOCUMENTS 4,588,242 A 5/1986 McDowell
6,645,001 B2 * 11/2003 Okano ..... 439/492
6,743,045 B1 * 6/2004 Hayashi et al. ..... 439/495
6,749,458 B1 * 6/2004 Kuo et al. ..... 439/484

FOREIGN PATENT DOCUMENTS

DE 31 27 704 A1 5/1982
DE 37 81 019 T2 11/1987
DE 198 35 670 A1 4/2000
DE 103 26 318 B3 3/2005

* cited by examiner

*Primary Examiner*—Khiem Nguyen
(74) *Attorney, Agent, or Firm*—Lawrence E Laubscher, Sr.; Lawrence E Laubscher, Jr.

(57) ABSTRACT

A sectional electrical connector for flat cables includes separable lower and upper horizontal sections formed from a relatively hard synthetic plastic material, at least one electrical contact having a horizontal bus bar portion mounted in the lower section, and a vertical portion extending upwardly toward the upper section, and seal strips integral with and arranged between the sections to seal the space between the sections surrounding the contact vertical portion, the seal strips being formed from a relatively soft synthetic plastic material. In one embodiment, the contact vertical portion comprises an insulation piercing contact for engaging the conductor of an insulated conductor contained in the flat cable. In a second embodiment, the vertical contact portion comprises a pin for connection with one or more components of a printed circuit board.

14 Claims, 7 Drawing Sheets

Fig. 3b
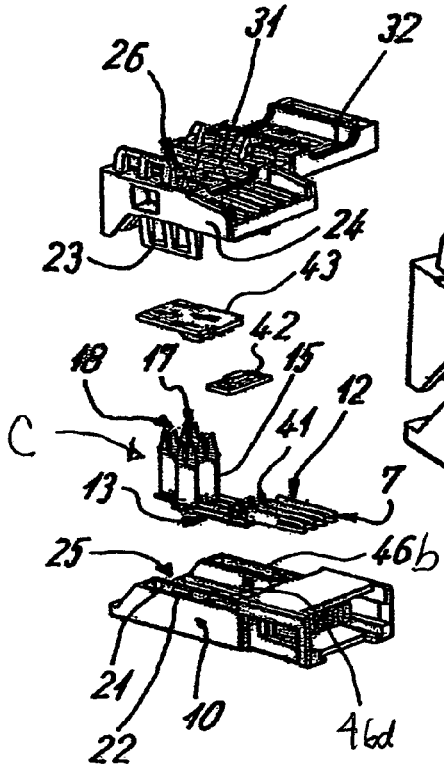
Fig. 3a
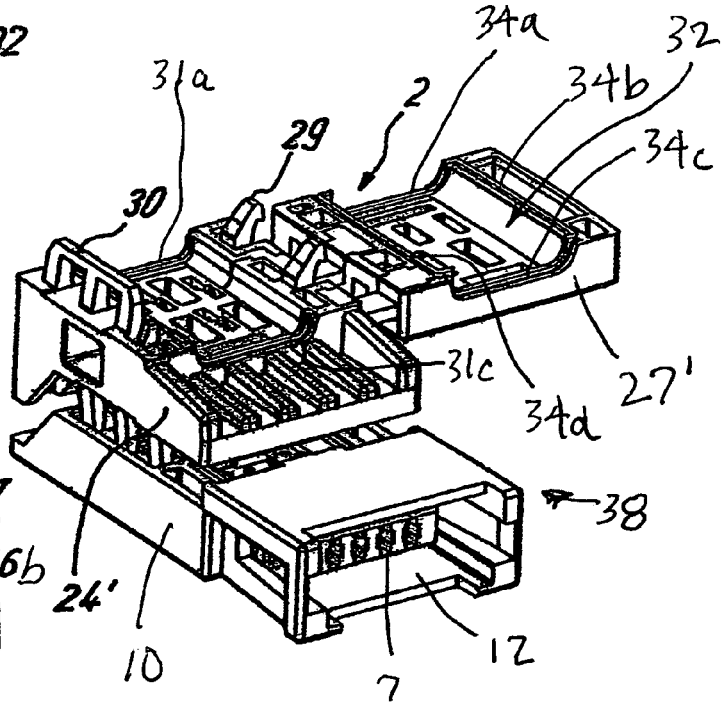
Fig. 3d
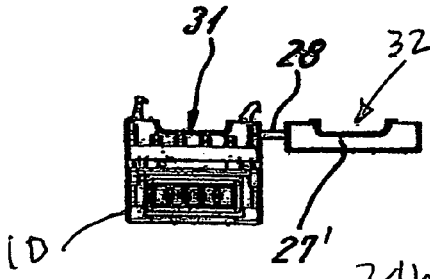
Fig. 3c
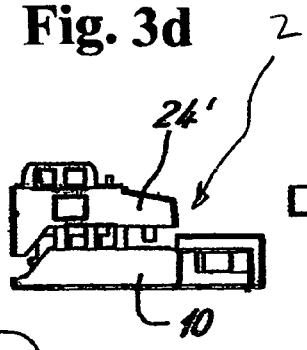
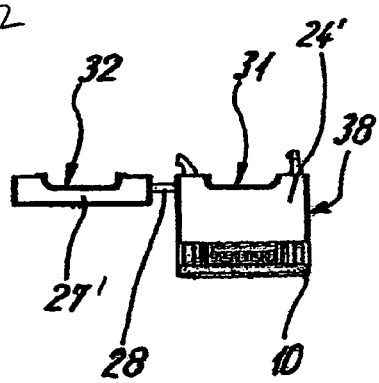
Fig. 3e
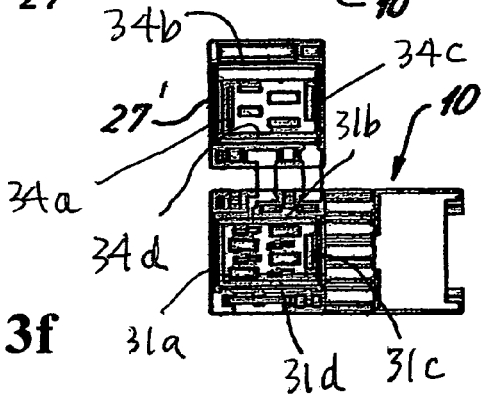
Fig. 3f Fig. 4b
Fig. 4a
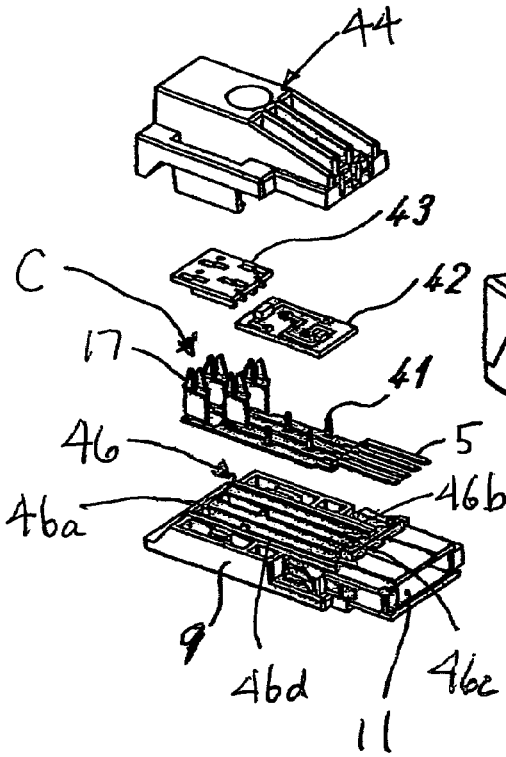
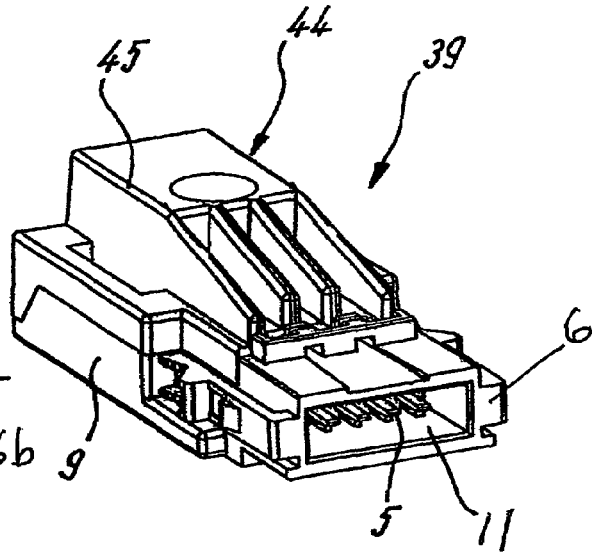
Fig. 4d
Fig. 4e
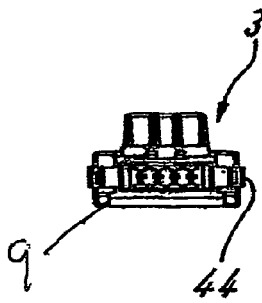
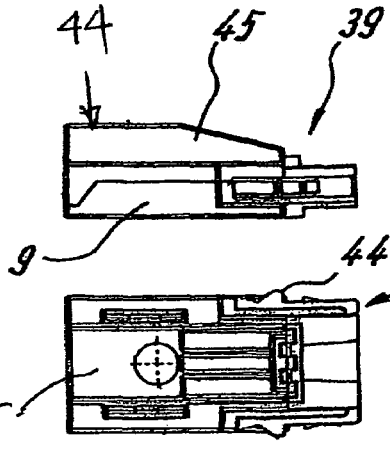
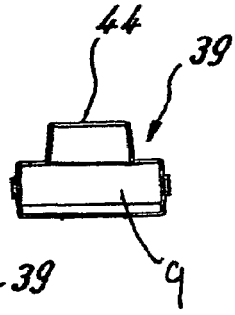
Fig. 4c
Fig. 4f Fig. 7a
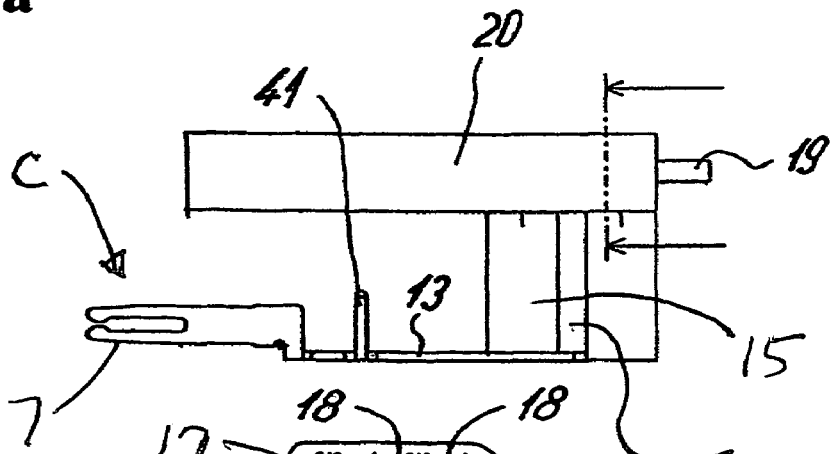
Fig. 7b
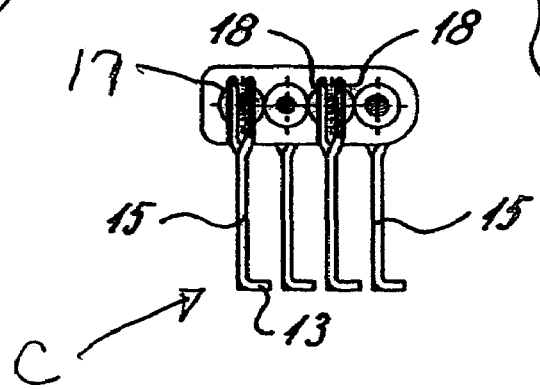
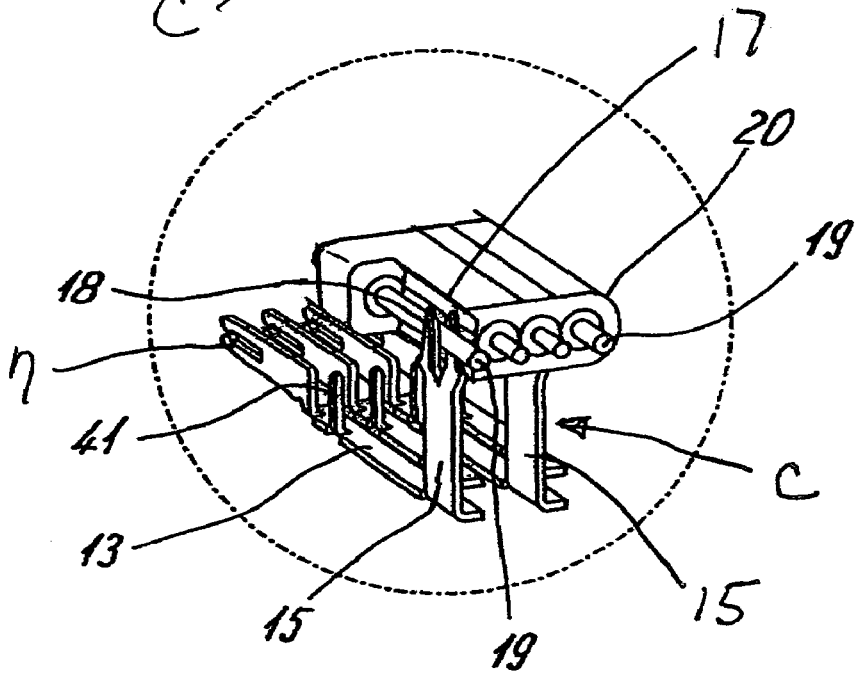
Fig. 7c

ELECTRICAL CONNECTOR FOR FLAT CABLES AND CONTACT ELEMENT THEREFOR

BACKGROUND OF THE INVENTION

1. Field of the Invention

A plug and socket electrical connector arrangement for flat cables includes separable lower and upper horizontal connector sections formed from a relatively hard synthetic plastic material, at least one electrical contact having a horizontal bus bar portion mounted in the lower section, and a vertical portion extending upwardly toward the upper section, and seal means arranged between the sections for sealing the space around the upper extremities of the contact vertical portion, said seal being integral with the connector sections and being formed from a relatively soft synthetic plastic material.

2. Description of the Related Art

It is well known in the patented prior art to provide electrical connectors with insulation piercing contacts carried by a bus bar mounted in the connector body, thereby to pierce the insulation layer of an insulated conductor that is part of a cable. It is also known to provide connectors with electrical components, such as a resistor, whereby the connector serves as a termination element for a cable.

In the case of a sectional connector, one problem that has occurred is that of sealing the contacts within the connector against deleterious environmental conditions, such as rain, ice, gaseous conditions and the like. Accordingly, the present invention was developed to provide a simple, inexpensive sectional plug and socket-type connector that is sealed against the elements.

BRIEF SUMMARY OF THE INVENTION

Accordingly, a primary object of the invention is to proved a sealed sectional plug and socket connector arrangement including a sectional connector housing having lower and upper sections, electrical contact means having a horizontal bus bar portion mounted in the lower section, and an upwardly directed vertical contact portion extending adjacent the upper section, and seal means sealing the space between the sections surrounding the upper end of the vertical contact portion, the lower and upper sections being formed from a relatively hard synthetic plastic material, said seal means being integral with at least one of the sections and being formed from a relatively soft synthetic plastic material.

A more specific object of the invention is to provide in the upper section a first upwardly-directed trough for receiving the lower half of the circumferential surface of a flat cable, and a cover section containing a downwardly-directed second trough arranged above the first trough to receive the upper half of the circumferential surface of the cable, the upper end of the vertical contact comprising an insulation-piercing contact for piercing the insulation layer and engaging the conductor of one of the insulated conductors within the flat cable. In this embodiment, the seal means extend circumferentially around the cable to seal the space between the outer circumferential surface of the cable and the inner circumferential surface of the trough.

According to another object of the invention, the connector comprises a plug and socket-type termination device including a vertical contact pin connected with a component on a printed circuit board that is arranged between the lower and upper sections.

BRIEF DESCRIPTION OF THE DRAWINGS

Other objects and advantages of the invention will become more apparent from a study of the following specification, when viewed in the light of the accompanying drawings, in which:

FIG. 3*a* is a front perspective view of the apparatus of FIG. 2*b* with the cable removed, FIG. 3*b* is an exploded view of apparatus of FIG. 3*a*, and FIGS. 3*c*-FIGS. 3*f* are front, left side, rear, and top plan view, respectively, of the apparatus of FIG. 3*a;*

FIGS. 4*a*-4*f* are exploded, front perspective, front, side elevation, rear, and top plan views of a second embodiment of the invention;

FIGS. 7*a*-7*c* are side elevation, right hand end and perspective sectional views of the staggered insulation-piercing contact arrangement of FIG. 5.

DETAILED DESCRIPTION OF THE INVENTION

Figure 1B:
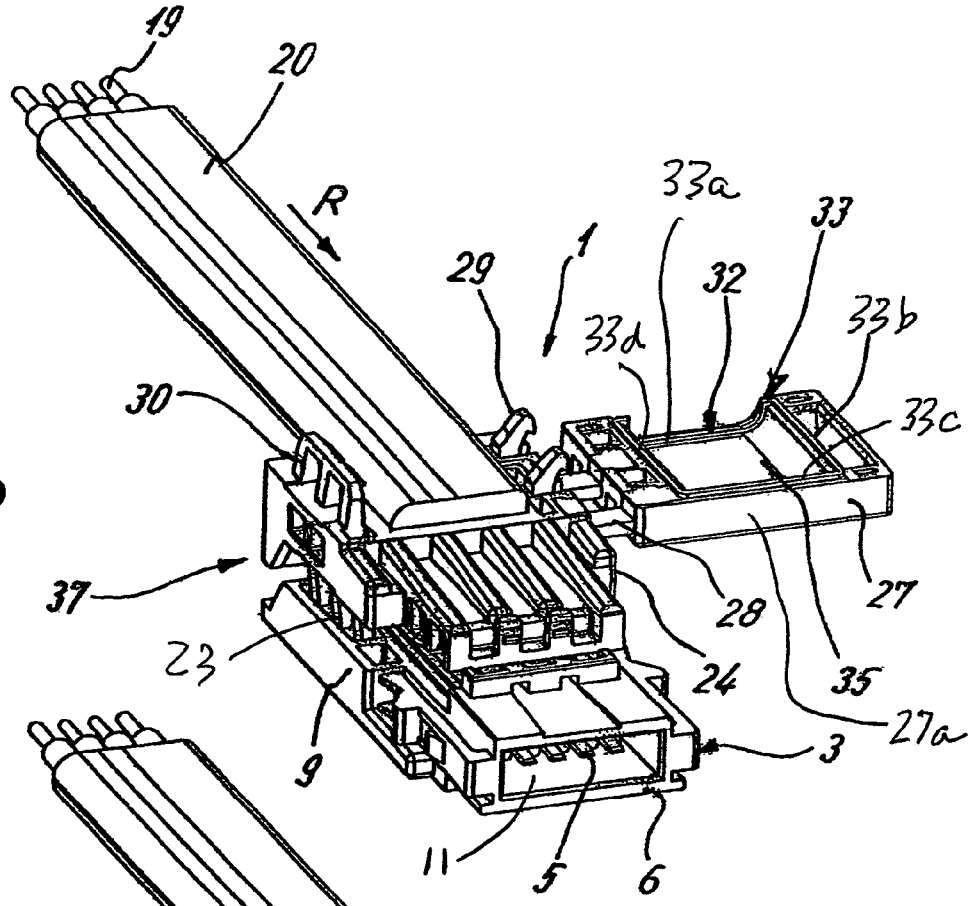
FIGS. 1*a* and 1*b* are perspective views of the sectional plug connector of the present invention illustrating the cover section in its closed and open positions, respectively.
Figure 1A:
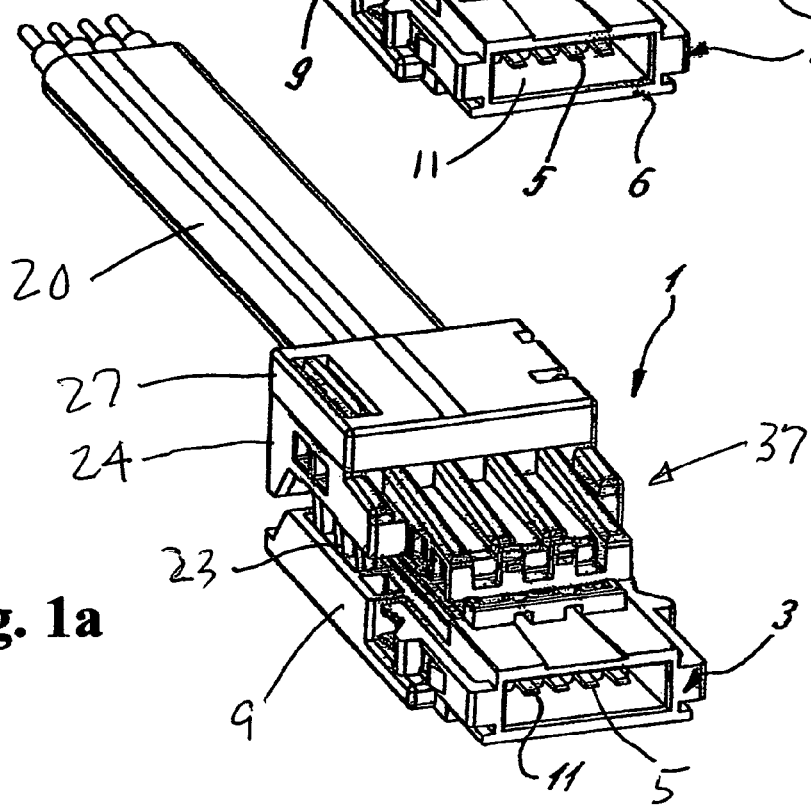

Referring first more particularly to FIGS. 1*a* to 2*c*, the plug and socket connector arrangement of the present invention includes the plug means 1 of FIGS. 1*a* and 1*b* including a sectional plug housing 37 having a male plug end portion 3 adapted for connection with the female socket end portion 4 of the sectional housing 39 of socket connector 2. The sectional plug housing 37 of FIG. 1*a* includes a lower section 9, an upper section 24, and a cover section 27, each formed from a relatively hard synthetic plastic material. As will be explained in greater detail below, the upper section 24 has an upper horizontal surface containing a first flat-bottomed trough 31 (FIG. 3*b*) that receives the lower circumferential half portion of one end of a flat cable 20 containing a plurality of parallel insulated conductors 19. The cover section 27 is pivotally connected with the upper section 24 by flexible hinge means 28 for displacement between the closed position of FIG. 1*a* and the open position of FIG. 1*b*. Catch hooks 29 and eyelets 30 are provided on the upper housing member for engagement with corresponding fasteners on the cover section 27, thereby to fasten the cover section to the upper section when in the closed position of FIG. 1*a*. The cover section 27 contains a second flat-bottomed trough 32 that receives the upper circumferential half portion of the flat cable 20 when the cover section is in the closed position of FIG. 1*a*. The second trough 32 terminates within the cover section 27 to define an end wall 27*a* which serves as a stop for limiting the extent of insertion of the cable into the plug connector housing 37.

In accordance with the present invention, integral sealing means 33 are mounted on the cover section 27 around the trough 32, including a first transverse strip 33*a* at the cable introduction end of the trough 32, a pair of longitudinal strips 33*b* and 33*d* on opposite sides of the trough 32, and a second transverse strip 33*c* along the top edge of the transverse wall 27*a*. As will be explained below, the integral sealing strips 33*a*-33*d*—as well as the flexible integral hinge strips 28—are formed from a synthetic plastic material that is softer and more flexible that the synthetic plastic material from which the lower, upper and cover sections 9, 24 and 27, respectively, are formed. Corresponding transverse and longitudinal sealing strips, not shown in FIGS. 1*a* and 1*b*, are provided on the upper surface of the upper section 24.

Figure 2B:
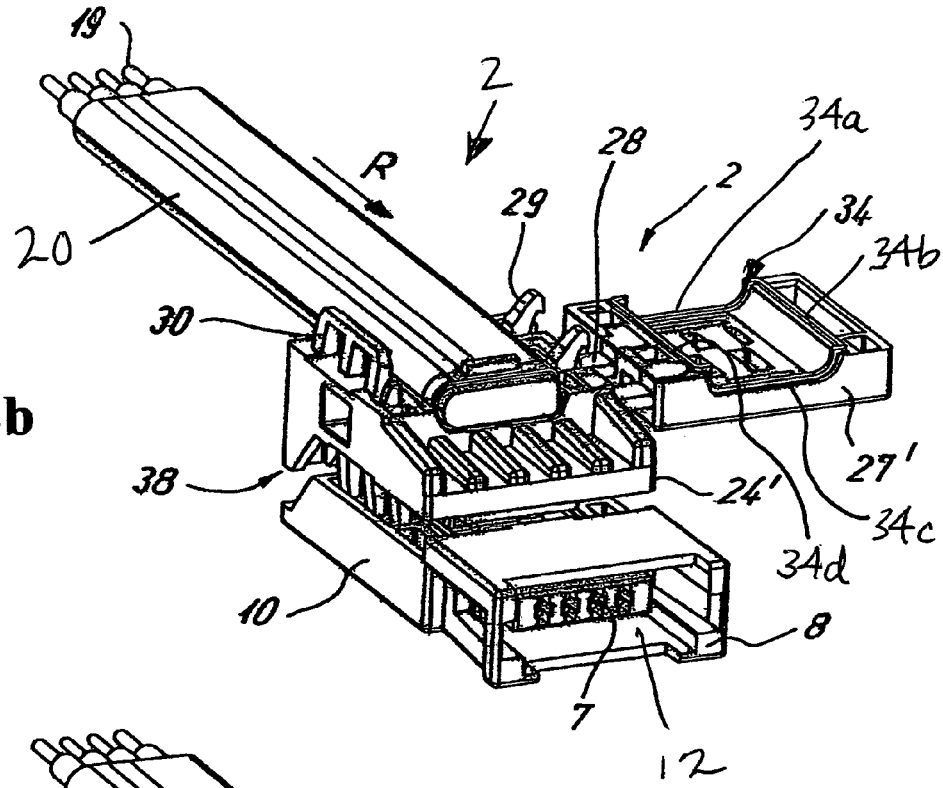
FIGS. 2*a* and 2*b* are corresponding perspective views of the socket connector of the present invention.
Figure 2A:
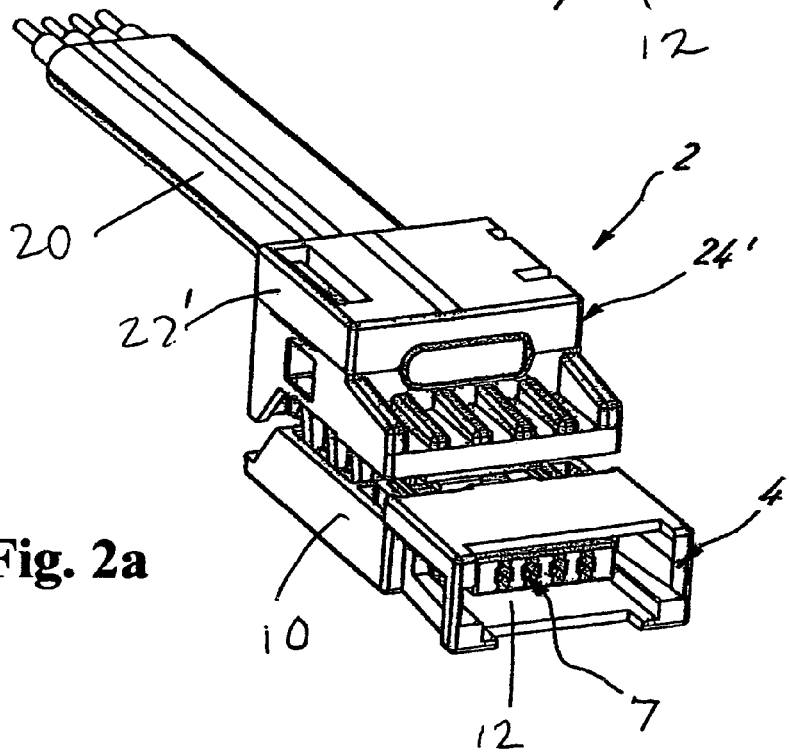
Figure 5:
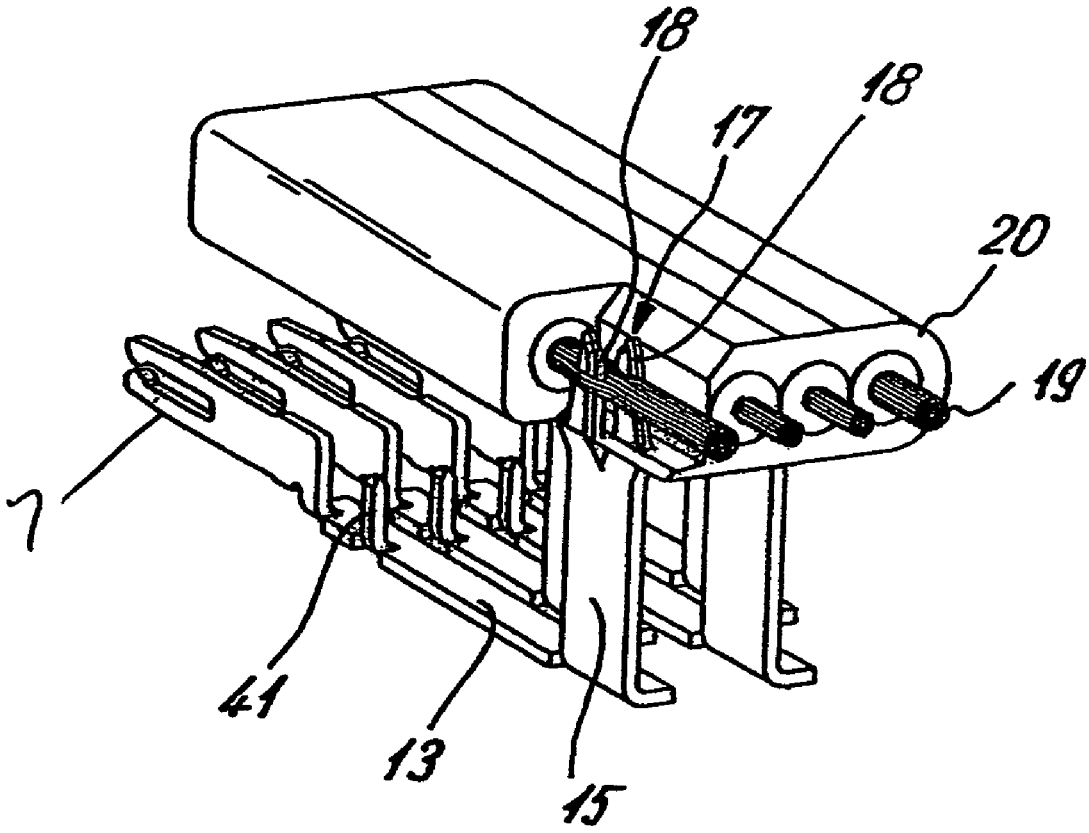
FIG. 5 is a rear perspective sectional view of the insulation-piercing contact means of FIGS. 1-3, FIGS. 6*a* and 6*b* are perspective and detailed perspective view of one of the contact means of FIG. 5.
Figure 6A:
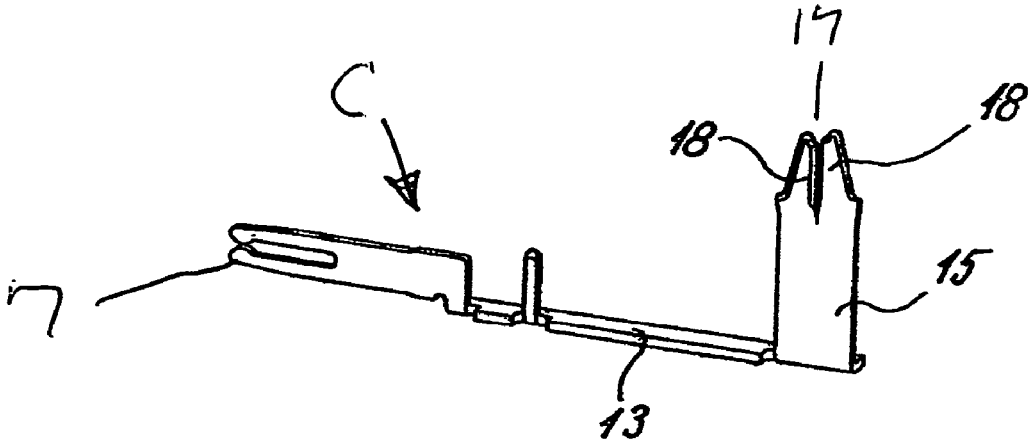
Figure 6B:
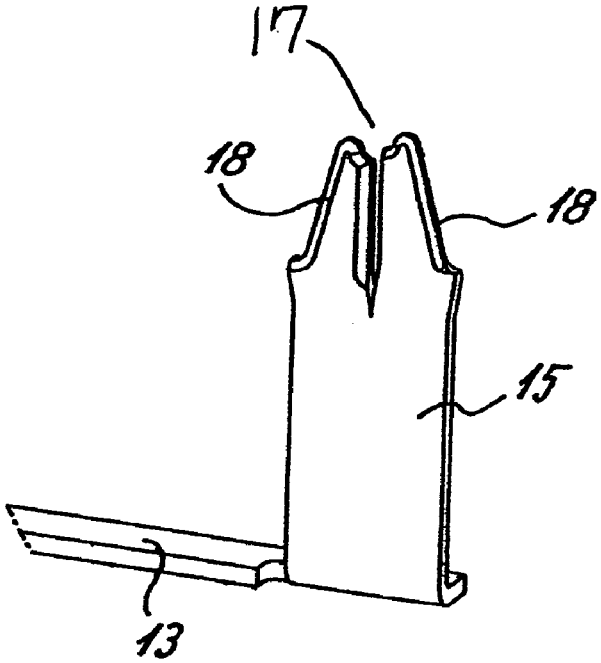

Referring now to FIGS. 2*a*-3*f*, the socket connector 2 includes a sectional socket housing 38 having a lower section 10, an upper section 24', and a cover section 27' that is pivotally connected with the upper section 24' by integral hinge means 28. As shown in FIG. 3*b*, the lower socket section 10 is provided at one end with a horizontal surface that contains a longitudinal groove 25 that defines a seat for receiving a plurality of electrical contact means C. The longitudinal groove 25 communicates with a recess 12 contained in the other end of the lower section 10. As best shown in FIGS. 5*a* to 7*c*, each electrical contact means C includes a horizontal bus bar portion 13, a bifurcated female contact portion 7 extending longitudinally at one end from the bus bar portion 13, a first vertical contact 15 at the other end of the bus bar, and a second vertical contact pin 41 intermediate the ends of the bus bar portion. The upper ends of the first vertical contact 15 is provided with an insulation-piercing contact 17 having knife edges 18, as is known in the art. Thus, when the bus bar portions 13 of the contact means C are seated in the groove 25 contained in the lower unit 10, the longitudinal contacts 7 extend into the socket recess 12, as shown in FIGS. 2*a*, 2*b* and 3*a*. The vertical first insulation-piercing contacts 17 extend upwardly through corresponding through openings 26 contained in the flat bottom wall of the first trough 31 provided in the upper horizontal surface of the upper section 24'. As shown in FIG. 3*a*, the upper section 24' is fastened to the lower section 10 by means of eyelet and catch means 23. In a similar manner, the upper section 24 of the plug housing 37 of FIGS. 1*a* and 1*b* is fastened to the lower plug housing section 9 by eyelet ant catch means 23. Also, in the plug connector of FIGS. 1*a* and 1*b*, male tab terminals 5 extend from contact means C (not shown) contained in the lower plug section into the plug recess 11. In both the plug connector of FIGS. 1 and 1*a* and the socket connector of FIGS. 2*a*-3*f*, the knife edges 18 of the insulation-piercing contacts extend within the trough 31 via openings 26 (FIG. 2*b*) to pierce the insulation layers and to electrically engage the respective conductors 19, as shown in FIGS. 5 and 7. The closed cover sections 27 and 27' serve to maintain the insulation-piercing contacts in electrical engagement with the respective conductors 19.

Referring to FIG. 3*b*, it will be seen that a printed circuit board 42 and a support plate 43 are mounted between the lower section 10 and the upper plug section 24'. A similar circuit board and support plate (not shown) are provided between the lower plug section 9 and the upper section 24 of FIGS. 1*a* and 1*b*. The vertical second contact pins 41 extend into electrical engagement with the printed circuit board 42 to connect the bus bars 13 with corresponding circuits on the printed circuit boards. The support boards 43, which support the tips of the contact pins, may also support electrical components connected with the printed circuit board 42.

As shown in FIG. 3*a*, in accordance with a characterizing feature of the present invention, in order to seal the space between the sections surrounding the vertical contact portions of the contacts C, seal means 31 and 34 are provided on the upper surface of the upper section 24 and on the lower surface of the cover section 27', respectively. The seal means 31 includes a pair of transverse integral seal strips 31*a* and 31*c* at opposite ends of the first trough 31, and corresponding transverse strips 34*a* and 34*c* are provided at opposite ends of the second trough 32. Thus, when the end of the flat cable 20 is introduced into the troughs as shown in FIGS. 2*a* and 2*b*, the seals 31*a* and 34*a* and the seals 31*c* and 34*c* cooperate to seal the spaces at each end of the troughs between the outer circumferential surface of the cable and the corresponding concave surfaces of the troughs 31 and 32. The seal means also include additional longitudinal seal strips 34*b* and 34*d* on the cover section 27' that cooperate in sealing engagement with corresponding longitudinal seal strips 31*b* and 31*d* provided on the horizontal top surface of the upper section 24'. The integral seal strips of the sealing means and the cover section hinge means 28 are formed from a synthetic plastic material that is softer and more flexible than the synthetic plastic material from which the socket sections 10, 24' and 27' are formed.

In the second embodiment of the invention shown in FIG. 4, the connector housing arrangement 39 includes a cable termination section 44 mounted upon the lower plug section 9 (rather than a upper section having a hinged cover section, as shown in the first embodiment of FIGS. 1*a*-3*f*.) As in the plug embodiment of FIGS. 1*a* and 1*b*, the contact means C includes longitudinal male contact tabs 5 that extend within the end recess 11 contained in the plug end of the lower section. The first vertical insulation-piercing contacts 17 are not used in this embodiment, and the second vertical contact pins 41 extend into electrical engagement with the circuits on the printed circuit board 42, as stabilized by the support board 43. In this embodiment, the printed circuit board includes an electrical component such as a predetermined resistive attenuation load, for connection with the end of a cable by a plug or socket connector. Integral seal means 46 including transverse strips 46*a*, 46*c* and longitudinal strips 46*b*, 46*d* of softer synthetic plastic material are provided on at least the lower housing section 9 for sealing the assembled cable termination housing 39.

As is known in the art, the integral formation of the softer seal strip and hinge strip components with the harder connector sections may be achieved during an injection molding process by the selective introduction of the harder and softer synthetic plastic materials. Alternatively, it is possible to superimpose one material upon another in order to achieve the desired production of the softer integral components. One example of the softer synthetic plastic material is a thermoplastic elastomer (TPE), such as TC4MGA (Shore hardness 45), TC5MGA (Shore hardness 50), or TC6MGA (Shore hardness 67) produced by Kraiburg Holding GmbH & Co. KG of Germany. One example of the harder synthetic plastic material is a part crystalline thermoplastic polyester material PBT/PET, such as the POCAN® product Pocan-KO-2-7503/1 sold by Lanxess Deutschland GmbH Ltd. of Germany.

As shown in FIGS. 5 and 7*a*-7*c*, the lengths of the bus bar portions 13 of the contact means C may be varied so that the vertical portions 15 and the insulation piercing contacts are staggered relative to each other, thereby to effect the proper piercing of the insulation layers of the contacts.

While in accordance with the provisions of the Patent Statutes, we have illustrated and described the best form and embodiments of the invention now known to us, it is apparent that changes may be made without deviating from the inventive concepts set forth above.

What is claimed is:

1. An electrical connector arrangement including plug and socket components, comprising:

(a) a sectional generally rectangular connector housing (37; 38; 39) including:

(1) a lower housing section (9; 10) having a first end portion (6; 8) containing a longitudinal recess (11; 12), said lower section having a second end portion having a horizontal upper surface that contains groove means (25) that communicate with said longitudinal recess; and (2) an upper housing section (24; 24'; 44) mounted on said lower housing section;

(3) said upper and lower housing sections being formed from a relatively hard synthetic plastic insulating material;

(b) a plurality of electrically conductive contact means (C), each of said contact means including:

(1) a horizontal bus bar portion (13) mounted in said groove means;

(2) a first contact portion (5; 7) extending longitudinally from one end of said bus bar portion into said recess; and (3) at least one second contact portion (17; 41) extending orthogonally upwardly from said bus bar portion beyond said lower section horizontal upper surface;

(c) an electrical component (19; 42) arranged above said groove means, said component being electrically connected with said second contact portion; and (d) seal means (31; 33; 34; 46) arranged on at least one of said lower and upper housings for at least partially sealing the space surrounding said second contact portion, said seal means being formed from a relatively soft synthetic plastic material.

2. An electrical connector as defined in claim 1, wherein said lower section first end comprises a male plug connector (3) adapted for insertion within the socket opening of a companion socket connector.

3. An electrical connector as defined in claim 1, wherein said lower section first end comprises a socket connector (4) containing a socket opening (12) for opening for receiving the plug end (3) of a companion male plug component (1).

4. An electrical connector as defined in claim 1, wherein said seal means is integral with its associated connector section.

5. An electrical connector as defined in claim 4, wherein said electrical component comprises a printed circuit board (42), and further wherein said second contact portion comprises a conductive pin (41) in electrical engagement with said circuit board.

6. An electrical connector as defined in claim 4, wherein said electrical component comprises an insulated conductor (19); and further wherein said second contact portion comprises an insulation piercing contact (17) for penetrating the insulated layer and to electrically engage the conductor.

7. An electrical connector arrangement as defined in claim 6, wherein said second contact portion comprise insulation piercing means (17); and further wherein said upper section comprises a generally rectangular section (24, 24') including a first end portion containing a first flat-bottomed trough (31) for receiving an end portion of the flat cable, the bottom portion of said trough containing a plurality of through openings (26) through which said insulation piercing contacts extend, respectively; whereby said piecing contacts pierce the insulation layers and come into electrical engagement with the electrical conductors, respectively; and further including:

(e) a cover section (27; 27') connected with said upper section above said first trough, said cover section being formed from a relatively hard synthetic plastic material and having a horizontal bottom surface containing a second flat-bottomed trough (32) opposite said first trough, whereby when the end of a flat cable is contained within said first and second troughs, said troughs circumferentially enclose the flat cable.

8. An electrical conductor as defined in claim 7, wherein said seal means includes first transverse seal strips (31*a*, 33*a*, 34*a*, 46*a*) arranged at one end of each of said first and second troughs for completely circumferentially sealing the space between the outer circumferential surface of the cable and the adjacent trough surfaces, respectively.

9. An electrical connector as defined in claim 8, wherein said seal means includes first longitudinal seal strips (31*b*, 31*d*; 33*b*, 33*d*; 34*b*, 34*d*; 46*a*) carried by said sections on opposite sides of said troughs, said side strips cooperating to at least partially seal the space around said second contact portions.

10. An electrical conductor as defined in claim 8, wherein at least one of said first and second troughs terminates within the associated connector section, thereby to define a transverse wall (27*a*) that serves as a stop for limiting the extent of insertion of the flat cable into the troughs.

11. An electrical connector as defined in claim 10, and further including a second transverse seal strip (33*c*) carried by said transverse wall for sealing engagement with the associated connector section.

12. An electrical connector as defined in claim 8, wherein said first and second troughs extend completely through the associated sections, respectively; and further including second transverse seal strips (31*c*; 34*c*) arranged at the other ends of said troughs for completely sealing the circumferential space between the flat cable outer surface and the adjacent trough surfaces.

13. An electrical connector as defined in claim 5, wherein said upper section comprises a housing (44) defining cable termination means (39).

14. An electrical housing as defined in claim 7, and further including hinge means (28) connecting said cover section for movement between closed and open positions relative to said upper section, and releasable fastener means (29,30) fastening said cover section to said upper section when said cover section is in the closed position relative to said upper section; said hinge means comprising at least one hinge strip (28) integral with said upper and cover sections, said hinge strip being formed from a synthetic plastic material that is softer than that of said upper and cover sections.

* * * * *